United States Patent [19]

Thomsen

[11] Patent Number: 4,751,919

[45] Date of Patent: Jun. 21, 1988

[54] WATER JET MASSAGE APPARATUS AND METHOD

[76] Inventor: Merlin E. Thomsen, 16733 SE. Ankeny St., Portland, Oreg. 97233

[21] Appl. No.: 17,216

[22] Filed: Feb. 20, 1987

[51] Int. Cl.[4] ..... A61H 9/00

[52] U.S. Cl. ..... 128/66; 128/64

[58] Field of Search ..... 128/33, 37–40, 128/47, 50, 53, 64–66, 400, 402; 5/450, 451, 453, 435

[56] References Cited

U.S. PATENT DOCUMENTS

| | | | |
|---|---|---|---|
| 3,747,916 | 7/1973 | Benson | 5/435 |
| 4,112,943 | 9/1978 | Adams | 128/64 |
| 4,339,833 | 7/1982 | Mandell | 128/66 |
| 4,607,405 | 8/1986 | Ellis et al. | 128/66 |
| 4,651,720 | 3/1987 | Baus | 128/38 |

FOREIGN PATENT DOCUMENTS

| | | | |
|---|---|---|---|
| 2003137 | 7/1971 | Fed. Rep. of Germany | 128/402 |
| 2161678 | 6/1973 | Fed. Rep. of Germany | 128/66 |
| 161694 | 5/1923 | Switzerland | 128/66 |

OTHER PUBLICATIONS

Floatation Sleep Industry, Mar. 1985, p. 61, advertisement.

*Primary Examiner*—Stephen C. Pellegrino
*Assistant Examiner*—Ralph Lewis
*Attorney, Agent, or Firm*—Mattern, Ware, Stoltz & Fressola

[57] ABSTRACT

A water jet massage apparatus comprises a platform having a bench mounted thereon, and an overlying lid arranged for pivotal movement between an open position in which a person may gain access to the bench and a closed position in which the lid is lowered onto the bench. The lid includes top, front, rear, and opposite side walls, and also has a bottom wall formed of flexible, water-proof material which drapes over and covers a person reclining on the bench when the lid is closed. The water-tight cavity in the lid defined by the aforementioned walls contains a laterally extending, longitudinally movable water manifold which mounts and supplies water to a plurality of pulsating water jet spray heads which direct a multitude of pulsating jets of water downward onto the flexible bottom wall which loosely covers a person reclining on the bench, keeping him dry. Spent water from the water jet heads finds its way to side gutters in the chamber whereupon the water drains from the water-tight cavity into a holding tank where it is reheated and recycled continuously. The effect is a multitude of pulsating massaging water jets impinging on the flexible material draped across the body, the spray head assembly also moving longitudinally through the chamber from head to toe or any desired portion thereof.

13 Claims, 3 Drawing Sheets

WATER JET MASSAGE APPARATUS AND METHOD

BACKGROUND OF THE INVENTION

This invention relates to massage apparatus, and more particularly to an apparatus employing pulsating water jets positioned above a reclined body with a water-proof sheet of material interposed between the body and the water jet heads.

Various types of massage units have been provided heretofore and generally encompass mechanical and electrical hand-held units that vibrate, pulsate and provide heat. Also known in the art are shower heads arranged to expel water in pulsating fashion whereby a person taking a shower is treated to a variety of sprays which can be physically directed at will to any desired spot on the body. Typical of this type are the devices disclosed in U.S. Pat. Nos. 3,762,648; 3,801,019; and 4,190,207.

A third type of prior massage unit is illustrated by U.S. Pat. Nos. 2,832,336 and 4,112,943. The latter patent discloses a device that provides heated water circulated to a flexible bag positioned on a person's back, for example. The action of the circulating water through the bag, and the heat emanating therefrom, serve to provide therapy to a muscle injury or the like.

No device known to the applicant is directed to the concept of providing an individual reclining on a horizontal surface a whole body massage by utilizing pulsating and impacting jets of water as the massaging elements while also assuring the individual's dryness whether in a clothed or unclothed condition.

SUMMARY OF THE INVENTION

In its basic concept, this invention provides an apparatus employing pulsating water jets positioned above a reclined body with a water-proof sheet of material interposed between the body and the water jet heads in order to assure that the individual remains dry, the pulsating jet heads arranged for longitudinal movement along and above the body in order to effectively massage all or any desired portion of the individual's body, the apparatus preferably being self-contained in a compact cabinet arrangement.

It is by virtue of the foregoing basic concept that the principal objective of this invention is achieved; namely, the provision of a massage unit that maximizes the massaging effect of a mechanical massage, affords a maximum degree of relaxation to the user, and overcomes the disadvantages and limitations of the previously known massage units of the prior art.

Another object of this invention is the provision of a massage apparatus of the class described which affords the user or an operator complete control over the massaging action of the water jets, the length of travel of the water jets along the body, and the particular pulsating action of the jets in order to assure the user of a satisfying massage best suited to particular needs as may be determined at the time.

Still another object of this invention is to provide a massage apparatus of the class described by which a person may receive a water jet massage while remaining fully clothed.

A further objective of this invention is the provision of a massage apparatus of the class described which is may be completely self-contained in order to reduce overall operating costs and afford more selective control over the resulting massaging action of the unit.

A still further object of this invention is the provision of a massage apparatus of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figures 1, 2, 3, 4:
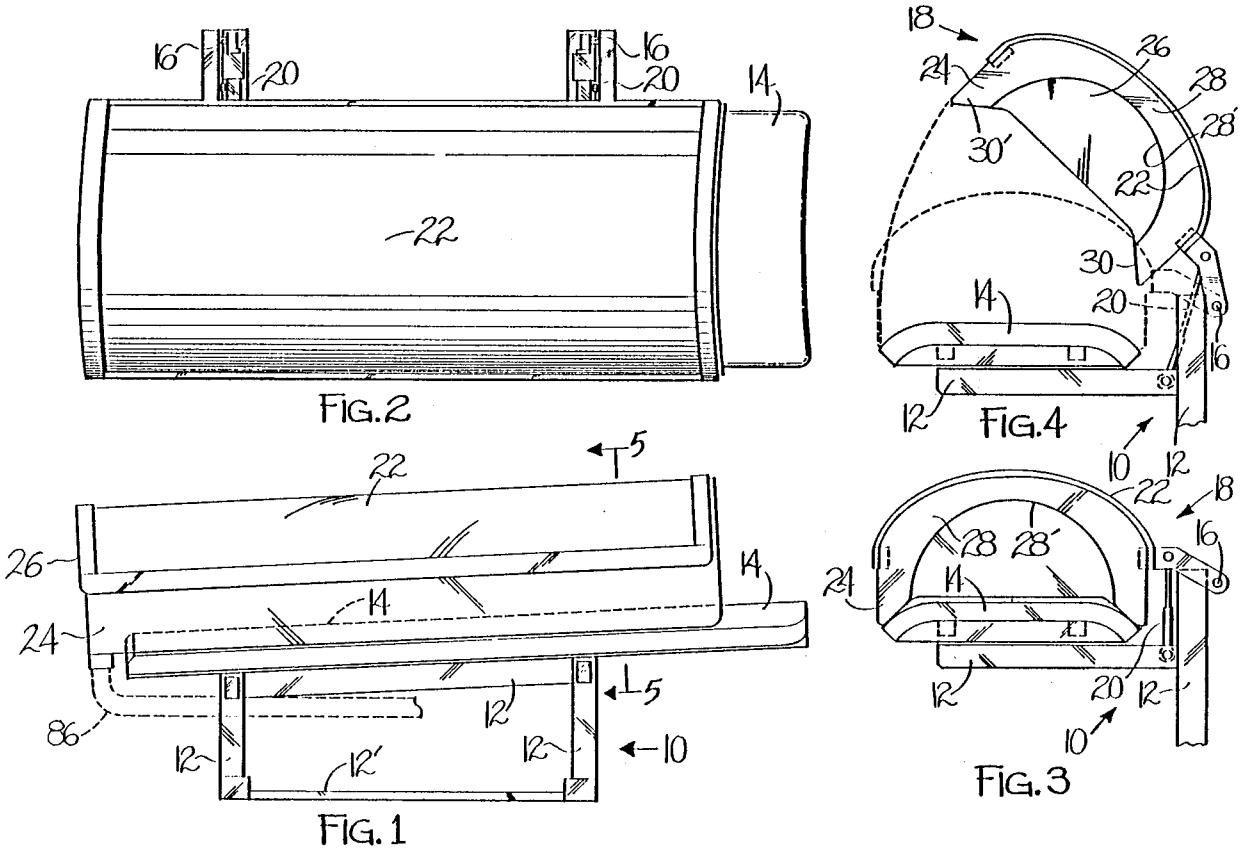
FIG. 1 is a side elevation of a massage apparatus embodying the features of this invention shown in closed, operative condition, the heating, plumbing and pumping systems normally carried by the base being omitted in this view.
FIG. 2 is a plan view of the massage device shown in FIG. 1 as viewed from the top in FIG. 1.
FIG. 3 is a fragmentary front end view of the apparatus as viewed from the right in FIG. 1.
FIG. 4 is a fragmentary front end view of the apparatus shown in FIG. 3 showing the lid in non-operative, open condition ready to receive an individual within the cabinet.
Figure 5:
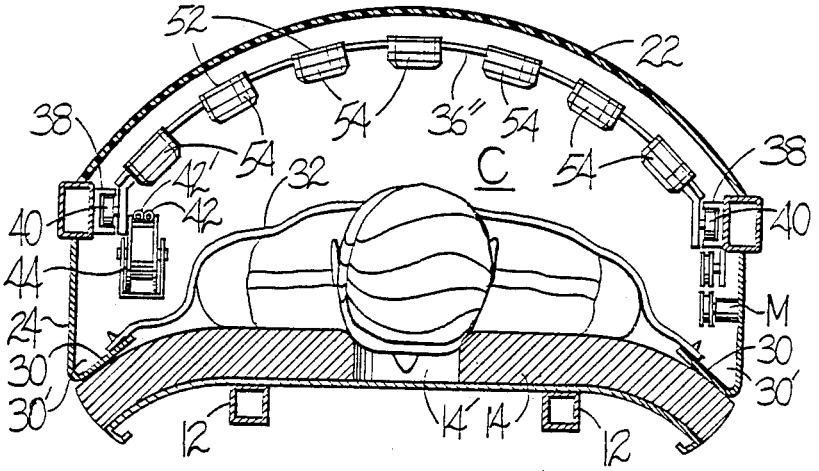
FIG. 5 is a transverse sectional view of the massage apparatus of FIG. 1 on an enlarged scale showing the positioning of a body within the cabinet and the massaging apparatus contained therein, the view taken on the line 5—5 in FIG. 1.

As an overview of this invention, a pulsating water jet massage apparatus comprises basically, a base assembly which mounts a preferably slightly inclined, padded bench upon which a person may recline face up or face down. An elongated lid is provided to overlie the bench and be tilted between the closed, operative position overlying the bench, as shown in FIGS. 3 and 5 of the drawings, and an open, elevated position as shown in FIG. 4, whereby access to and from the bench may be gained.

In the embodiment illustrated, the lid of the massage apparatus contains the working mechanism of the invention. As best seen in FIG. 5 of the drawings and will be understood from the description later, the lid includes a top, front, rear and side walls, and a bottom wall comprising a sheet of water-proof, flexible material mounted in a water-tight condition to the lower perimeter of the walls of the lid, thereby forming an elongated, hollow, water-tight chamber within the lid. In closed condition, the flexible material forming the bottom wall of the chamber loosely overlies the top surface of the bench and a person reclining on the bench, protecting the person from any moisture during the operation of the device.

The lid mounts a pair of opposite side rails which form tracks for a pair of trolleys mounted at opposite ends of a laterally extending water manifold that is preferably curved arcuately so as to position a plurality of pulsating water jet heads mounted thereon in a manner that best dircts the jets of water onto the flexible wall and hence about the contours of a body positioned underneath. Each head receives its supply of water from the manifold mounting it, the manifold being supplied with heated water under pressure and regulated by a pump and valves preferably carried by the base.

The manifold trolley is arranged for rolling movement on the side rail tracks substantially the full length of the cabinet lid. Drive means such as the cable arrangement shown in FIG. 10 of the drawings is connected to the opposite trolleys and arranged to move the manifold assembly forward and back along the tracks.

The lid preferably includes gutter means at the bottom of each side wall of the lid for receiving run-off water expelled by the heads and directing the water out of the lid and preferably back to the heater and pump for recirculation and reuse.

Accordingly, with the foregoing brief description of the basic structure of this invention, it will be understood that the operation is substantially as follows: First the lid is opened, a person reclines on the bench and closes the lid, whereupon the flexible material forming the bottom wall of the lid drapes loosely over the body and protects the person from becoming wet. The unit is then turned on, whereupon water heated in a holding tank is pumped through lines and valves which regulate the flow and the pulsation rate of the water to the head manifold where it is projected through the plurality of heads and into the hollow confines of the lid chamber. The flow, pulsation, temperature and other factors obviously can be adjusted as desired.

The water exiting the water jet heads strikes the flexible material covering a person's body in a pulsating fashion, across the width of the body as is clear from FIG. 5. The head manifold repeatedly moves longitudinally from one end of the cabinet to the other, thereby moving the plurality of heads along the entire length of the body or any portion thereof as may be desired. The spent water finds its way into the gutters and thence drained back into the water reservoir beneath the bench for reheating and reuse.

When finished, the lid is simply raised, the person steps out of the cabinet completely dry and having had a refreshing pulsating type massage without the significant inconveniences associated with mechanical massage units of the prior art.

With a general understanding of the invention having thus been presented, attention is now directed to the embodiment illustrated in the drawings. Referring principally to FIG. 1, there is provided a base frame, illustrated generally as 10, having upright, transverse and longitudinal beams 12, configured to support an inclined, preferably padded, bench 14 a convenient distance above a supporting floor surface. The base frame also includes a floor 12' which supports the operating systems of the massage apparatus, as will be described later.

As is seen best in FIGS. 2, 3 and 4 of the drawings, the uprights 12 support hinge members 16 which pivotally mount a longitudinally extending lid member 18 that is configured to overlie the inclined bench. The lid is operable between the closed and open positions of FIGS. 3 and 4. Preferably, fluid piston cylinders or dampers 20 are provided interconnecting the lid and the base to maintain the lid 18 in the open position of FIG. 4 and to control the rate of descent of the lid in its downward movement to the closed position of FIG. 3.

In the embodiment shown in the drawings, the lid member 16 includes a curved top wall 22, opposite lateral side walls 24, a rear wall 26 and a front wall 28. The rear wall 26 is preferably configured with a bottom edge that approximately follows the contour of the bench 14 so that when the lid is in the closed position of FIG. 3 the lower edge of the rear wall rests upon the bench. Similarly, the side walls 24 are configured to be disposed on the bench surface when the lid is in closed condition, and are of sufficient height as to position the top wall 22 an adequate distance above the bench as to form a hollow cavity within the lid which can accommodate a person reclining on the bench, as illustrated in FIG. 5 of the drawings. As also seen in FIG. 5, the opposite side walls include, at their lower edges, inwardly projecting, inclined gutter ledges 30 which serve a three-fold purpose: First, to provide a wide surface which rests upon the bench to support the lid in its closed position; secondly, together with the side walls, form a water run-off gutter 30' by which spent water is channeled to a water drain; and thirdly, to provide a surface to which a flexible lid bottom wall 32 may be attached. As illustrated best in FIGS. 3 and 4, the front wall 28 is configured as being substantially C shaped in order that a person lying on the bench may, if desired, position the head outside of the cabinet when the lid is in the closed position of FIG. 3. Alternatively, the user may recline face-down on the bench as illustrated, his face positioned over a breather opening 14' through the bench. This opening is provided in order that a person may be contained entirely within the lid, so that his neck and shoulders can be affected by the massage jets as well.

As seen best in FIG. 5, the lid member includes a flexible bottom wall 32 preferably formed of vinyl, rubber or other water-proof, flexible material, secured in water-tight fashion along the gutter ledge members 30, the lower edge of the rear wall 26, and about the contoured edge 28' of the opening in the front wall 28. Accordingly, it will be understood that with the provision of the flexible water-tight bottom wall of the lid, a hollow chamber C (FIG. 5) is formed within the lid between its top 22, bottom 32, side 24, front 28 and rear 26 walls. This chamber accordingly is water-tight regardless of whether the lid is in open or closed position.

The massage apparatus of this invention includes means by which water is introduced into the hollow chamber and directed, in a pulsating manner, onto the flexible bottom wall 32 of the lid, which in operation, overlies the body of a person reclining on the bench. Massage is accomplished by the gentle beating action of rapidly intermittent pulses of jet streams of water against the wall 32 and hence the body, the water-proof bottom wall 32 protecting the user from becoming wet.

Figure 10:
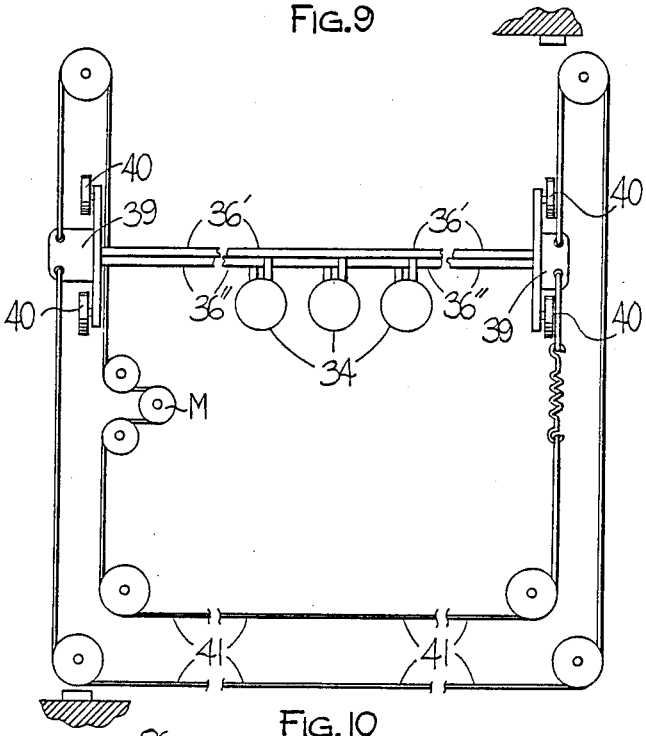
FIG. 10 is a foreshortened plan view of the water jet mounting carriage and the arrangement of pulleys and cables configured to afford the carriage uniform movement along the length of the carriage tracks contained within the cabinet.

In the embodiment illustrated, a plurality of water heads 34 are positioned along a laterally extending water supply manifold 36 that is arranged to be carried by longitudinally extending guide tracks 38 mounted on opposite side walls 24. As seen in FIGS. 5 and 10, the manifold 36 is supported by trolley assemblies 39 having rollers 40 which are carried by the U shaped guide tracks 38, thereby permitting free rolling movement of the laterally extending spray head manifold 36 longitudinally along substantially the full length of the lid within the hollow chamber C. As seen in FIG. 10, each trolley assembly 39 preferably includes a pair of spaced rollers 40 on each side of the manifold, in order to provide the manifold assembly stability.

Means is provided to move the spray head assembly along the guide tracks so as to move the pulsating water action along the length of a user's body. Illustrative of one drive mechanism is the cable assembly shown in FIG. 10 of the drawings. The cable arrangement shown provides for uniform tension urging opposite ends of the manifold to move in the same direction equally so that any binding or jamming during movement of the manifold from one end of the chamber to the other is eliminated. A drive motor M engages a cable drive pulley at a desired point to drive the cable 41 in one direction or the other, thereby pulling the manifold forward or back along the guide tracks.

Water must be delivered to the moving spray head manifold, and in the embodiment illustrated this is provided by a pair of flexible hoses 42, 42' (FIG. 5) connected to one end of the manifold. Since the hoses must be of adequate length to permit full travel of the manifold assembly from one end of the cabinet to the other, and since it is undesirable to have water-laden hoses free to lie on the flexible bottom wall 32 and interfere with the movement of the manifold, means is provided to maintain the flexible hoses in tensioned condition above the bottom wall 32 of the lid.

Figure 9:
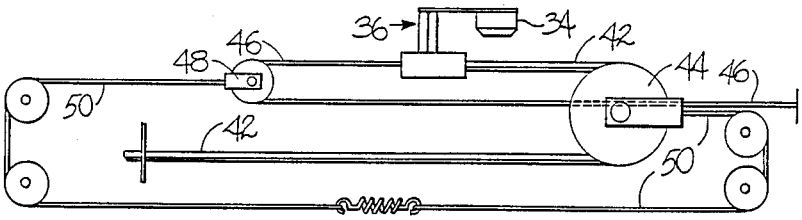
FIG. 9 is a fragmentary side elevation of an arrangement of tensioned pulleys configured to maintain the water supplying hoses to the heads in gently taut condition irrespective of the positioning of the water jet carriage along the length of its tracks.

FIG. 9 illustrates one arrangement for keeping the flexible hoses tensioned irrespective of the position of the manifold assembly along the length of the cabinet. Put simply, the flexible hoses are trained about a hose pulley 44 and thence directed out of the lid to a water supply. A system of cables and pulleys 46, 48, 50 interconnect the manifold trolley assembly 39 and the water hose pulley 44 in a manner which allows the water hose pulley to move in the same direction as the manifold but always applying resistive tension on the hoses in order to keep them substantially taut yet without placing excessive strain on the manifold assembly opposing its direction of travel.

The massage apparatus of this invention employs a plurality of special shower heads 34 capable of producing intermittent pulsating streams of water, the volume and pulsation of which are controllable remotely of the heads themselves. This is to say that the desired flow and the desired pulsation rate and intensity is achieved without physical manipulation at the head itself. This feature is an important aspect since, as explained earlier, the water head apparatus is isolated within the enclosed chamber C of the lid of the appartus.

Figure 6:
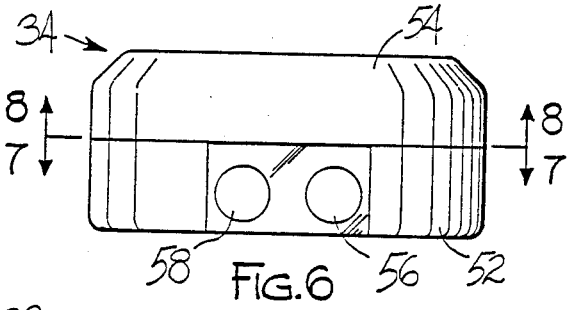
FIG. 6 is a front elevation of one of a plurality of pulsating water jet heads shown in FIG. 5, the view being on an enlarged scale.
Figure 7:
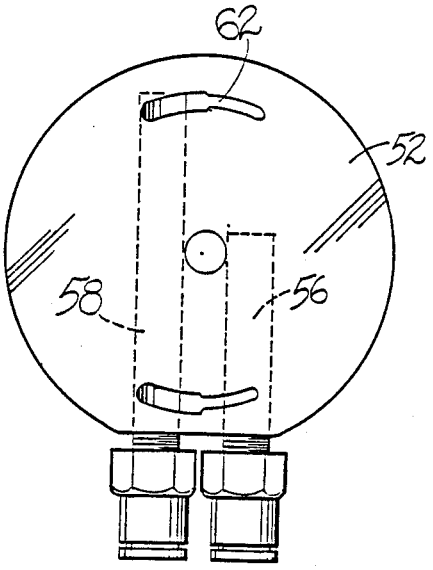
FIG. 7 is a plan view of the base half of the water jet head of FIG. 6, the view taken along the line 7—7 in FIG. 6.
Figure 8:
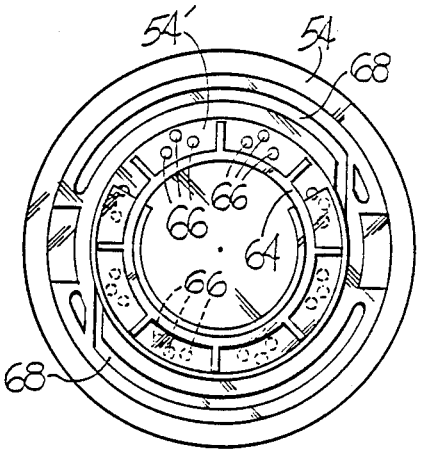
FIG. 8 is a bottom view of the upper half of the pulsating water jet head of FIG. 6, the view taken along the line 8—8 in FIG. 6.

Referring to FIGS. 6, 7 and 8 of the drawings, a shower head suitable for use in the massage apparatus of this invention comprises a head body base 52 and a head body top 54 which, when connected together, define between them an enclosed, cylindrical, hollow chamber 54'. The base 52 includes a pair of bores 56, 58, the bore 56 communicating with an opening 60 into the center of the hollow chamber, the bore 58 communicating with openings 62 into the hollow chamber near its peripheral edge. A turbine blade assembly 64 is contained within the hollow chamber and is configured to intermittently open and close a plurality of water jet spray orifices 66 as it rotates, being driven by the force of water supplied by the bore 58 associated with the outer openings 62 which are positioned to direct water flow through water passages 68 and against the blades of the turbine. Supplying water under pressure to the center opening 60 through the bore 56 balances the pressure within the hollow chamber and reduces the speed with which the turbine rotates and hence reduces the rate of pulsation.

As is seen best in FIG. 10 of the drawings, the manifold 36 in this embodiment includes two pipes 36', 36'', one pipe 36' supplying water under pressure to each of the center openings 60 of the plurality of heads 34, and the other pipe 36'' of the manifold supplying water under pressure to each of the side bores 58 of the plurality of heads.

Figure 11:
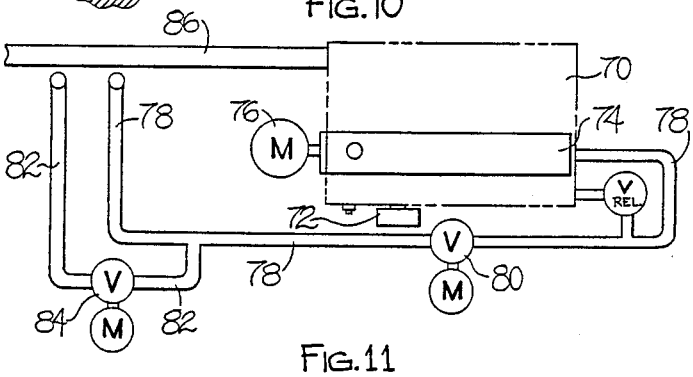
FIG. 11 is a fragmentary schematic plan view of the water heating and control system preferably carried by the base as viewed in FIG. 1, the water control system of the self-contained massage apparatus regulating water temperature, pressure and pulsating action supplied to the heads.

Means is provided to supply water under pressure to the water head manifold 36 in the manner required by the heads just described. The operating system shown in FIG. 11 illustrates an embodiment that is preferred because of its cost effective operation. The system shown in FIG. 11 is self-contained, recycles its spent water and therefore does not require the expense of fresh water and the heating of fresh water that typical shower massages require. As seen, a water pump 74 driven by motor 76 and heater 72 and a water pump 74 driven by motor 76 and arranged to move heated water under pressure out of the tank through water pipe 78. A valve 80, preferably motor-operated for convenience, is provided in line 78 to control the volume and pressure of water flow to the water heads. The water pipe 78 is directed upwards to the flexible hose 42 associated with the portion of the manifold, (pipe 36'' for example), supplying water to the side bore 58 of each shower head. A second water line 82 branches off of the water line 78, the second line having a second motor-operated valve 84. This water line 82 is connected to the flexible hose 42' that is associated with the portion of the manifold, (pipe 36' for example), which delivers water to the center opening 60 of each shower head. Controlling the valve 84, and thereby regulating water delivered to the center of the water turbine assembly 64, selectively varies the pulse rate of the water jet heads.

As described, the valves 80, 84 are preferably motor actuated, and preferably operable from a remote source such as a remote control unit (not shown), as are also the pump motor, heater and manifold trolley drive motor. This is desirable so that the total operation of the apparatus can be controlled in a timed sequence, by a computer, by an operator or by the user himself in order to achieve the most satisfactory results.

Water expelled from the heads, after striking the flexible bottom wall 32, drains to the side gutters 30', and by virtue of the inclined disposition of the lid and bench appartus, drains by gravity to a spent water return line 86, (FIGS. 1 and 10) whereupon the warm water is returned to the holding tank 70 for reheading and recirculation.

The operation, use and effects of the massage apparatus of this invention have been discussed in detail throughout the foregoing specification, and accordingly, a repetition thereof is not necessary. From the foregoing however it will be readily apparent to those skilled in the art that this invention provides a massage apparatus which is ideally suited for giving a fully automatic, mechanical, head to toe massage while involving the least possible involvement and inconvenience to the user who simply reclines in a completely relaxed, even clothed condition.

From the foregoing description of the structure of this invention it will also be apparent to those skilled in the art that various changes other than those already described may be made in the size, shape, type, number and arrangement of parts described hereinbefore without departing from the spirit of this invention and the scope of the appended claims.

Having thus described my invention and the manner in which it may be used, I claim:

1. A water jet massage apparatus comprising:

(a) a base (b) an elongated bench on the base configured to permit a person to recline thereon, (c) an elongated lid having top, front, rear and pppos-ite side walls and a flexible bottom wall of waterproof sheet material forming an elongated water-tight chamber thereinbetween, positioning means for arranging the lid in a juxtapose spaced overlying relationship with the bench with said flexible bottom wall sheet configured to loosely overlie and conform to the top surface contour of the body of a person reclining on the bench, (d) at least one water jet head contained within said water-tight chamber, the head having a plurality of water jet spray orifices directed to impact jets of water under pressure directly against said flexible bottom wall sheet, (e) water supply means communicating with said orifices for delivering pulsating jets of water under pressure through said orifices and impacting said pulsating jets of water against said bottom wall sheet, and (f) water drain means in said lid to drain water expelled into said chamber through said orifices.

2. The water jet massage apparatus of claim 1 wherein the bench includes an air breather opening therethrough positioned to permit a person reclined face down on the bench to breath when the flexible bottom wall of the lid overlies the user.

3. The water jet massage apparatus of claim 1 wherein the bench and the lid are inclined to permit gravity flow of water expelled into the chamber to said water drain means.

4. The water jet massage apparatus of claim 1 wherein said bench extends longitudinal forward of the overlying lid to allow the head of a person reclined on the bench to extend outwardly of the flexible bottom wall of the lid when the lid is overlying the bench.

5. The water jet massage apparatus of claim 1 wherein the water jet head is mounted on a laterally extending support that is configured for longitudinal movement through the chamber.

6. The water jet massage apparatus of claim 1 including a plurality of said water jet heads positioned along a laterally extending manifold that is mounted on a longitudinally movable trolley, and heads arranged to spray water directly onto said flexible bottom wall substantially across the full width of the water tight chamber, and power means engaging the trolley for moving it longitudinally within the chamber.

7. The water jet massage apparatus of claim 1 wherein the water supply means includes a water holding tank and a pump, and said water drain means includes a return drain pipe interconnecting the chamber and the holding tank to return water from the chamber to the holding tank for recycling.

8. The water jet massage apparatus of claim 7 including a main water supply line between said pump and said head, a first valve in the main water supply line for controlling the volume and pressure of water supplied to the head, a secondary water supply line connected to the head, and a second valve in the secondary water supply line for controlling the rate of pulsation of water jets from the head.

9. The water jet massage apparatus of claim 1 wherein the elongated bench and lid are dimensioned to confine between them substantially the entire body of a person to be massaged.

10. The water jet massage apparatus of claim 1 wherein plurality of said water jet heads are arranged to impact pulsating water jets against selected areas of the flexible bottom wall sheet overlying a body to be massaged.

11. The water jet massage apparatus of claim 10 including control means in the water supply means for controlling the delivery of impacting pulsating jets of water to selected areas of the flexible bottom wall sheet.

12. The water jet massage apparatus of claim 11 wherein the control means is arranged for operation by a person reclining on the bench.

13. A water jet massage apparatus comprising:

(a) a base, (b) an elongated bench on the base configured to permit a person to recline thereon, (c) an elongated lid having top, front, rear and opposite side walls and a flexible bottom wall of waterproof sheet material forming an elongated water-tight chamber thereinbetween, the bench and lid being dimensioned to confine between them substantially the entire body of a person to be massaged, said flexible bottom wall sheet configured to loosely overlie and conform to the top surface contour of the body of a person reclining on the bench, (d) a plurality of water jet heads contained within said water-tight chamber, each head having a plurality of water jet spray orifices directed to impact jets of water under pressure against selected areas of the flexible bottom wall sheet overlying a body to be massaged, (e) water supply means communicating with said orifices for delivering pulsating jets of water under pressure through said orifices and impacting said pulsating jets of water against said bottom wall sheet, (f) control means in the water supply means for controlling the delivery of impacting pulsating jets of water to selected areas of the flexible bottom wall sheet, and (g) water drain means in said lid to drain water expelled into said chamber through said orifices.

* * * * *